US007300206B2

(12) United States Patent
Fedeli

(10) Patent No.: US 7,300,206 B2
(45) Date of Patent: Nov. 27, 2007

(54) SELF-EMPTYING BAG HAVING A QUICK COUPLING BUCKLE ASSEMBLY, IN PARTICULAR FOR SHOULDER-STRAP

(76) Inventor: Benedetto Fedeli, 7 AV. Saint Roman, Monaco (MC)

( * ) Notice: Subject to any disclaimer, the term of this patent is extended or adjusted under 35 U.S.C. 154(b) by 579 days.

(21) Appl. No.: 10/963,528

(22) Filed: Oct. 14, 2004

(65) Prior Publication Data

US 2005/0084180 A1 Apr. 21, 2005

(30) Foreign Application Priority Data

Oct. 15, 2003 (IT) ..... RM2003A0474

(51) Int. Cl.
*B65D 30/00* (2006.01)
*A41F 1/00* (2006.01)
*A43C 11/00* (2006.01)

(52) U.S. Cl. ..... 383/3; 24/614; 24/625; 24/635; 24/662; 24/616; 441/40; 441/94; 206/522; 150/102

(58) Field of Classification Search ..... 383/3; 24/301–305, 163 R, 614, 616, 625, 635, 24/662; 150/102; 206/522; 441/40, 94
See application file for complete search history.

(56) References Cited

U.S. PATENT DOCUMENTS 5,791,026 A * 8/1998 Anscher ..... 24/615
6,283,182 B1 * 9/2001 Fedeli ..... 150/102
6,662,414 B1 * 12/2003 Niewiadomski ..... 24/625
2002/0040515 A1 * 4/2002 Uehara et al. ..... 24/614

* cited by examiner

*Primary Examiner*—Nathan J. Newhouse
*Assistant Examiner*—Avery Prioleau
(74) *Attorney, Agent, or Firm*—Young & Thompson

(57) ABSTRACT

A self-emptying bag having a quick coupling buckle assembly, in particular for shoulder-strap, has a buckle assembly (4) comprised of two parts (40, 41) that are respectively fixed to two sections (201, 202) of a shoulder-strap (200) of a bag so that a snatch on the bag, through the flexible transmission (30), operates the release mechanism and causes the expandable sack to be inflated to upset outside the contents in the bag. Flexible transmission (30) is connected to a coupling member (91) movable inside the first part (40) of the buckle assembly (4). The two parts of buckle are formed in such a way that first the second part (41) can be detached from the first part (40), and then the second part (41) can be detached from the coupling member (91) after a traction has been exerted on the coupling member (91).

1 Claim, 4 Drawing Sheets

SELF-EMPTYING BAG HAVING A QUICK COUPLING BUCKLE ASSEMBLY, IN PARTICULAR FOR SHOULDER-STRAP

This invention relates to a self-emptying bag having a quick coupling buckle assembly, in particular for shoulder-strap.

The same applicant is also the owner of the Italian patent No. 1.307.293 entitled "An ejection device to expel objects from the inside of a bag in the event of a bag-snatching". Such a device comprises an expandable sack which is arranged on the bottom of the bag below its lining. The expandable sack is connected to a small compressed gas bottle having a pierceable mouth so that the expandable sack is able to be inflated from a wait condition, wherein the expandable sack is empty, to an operated state wherein the expandable sack is inflated to a volume greater than the internal volume of the bag. A housing, which is connected to the small compressed gas bottle and to the expandable sack, internally carries a piercing element provided with an axial passageway communicating with the expandable sack through a hollow cylindrical body thereof which is movable under a pre-charged spring. A release mechanism of the pre-charged spring to push the piercing element is provided. A control member of the release mechanism comprises a Bowden-cable flexible transmission, that is retained in the one of its ends to the release mechanism, and in the other one of its ends, to a junction member joining in turn a portion of the bag designed to be held permanently by who wears the bag, such as a handle or a shoulder-strap. In particular, in the case of a shoulder-strap, the latter is comprised of two sections, which are joined each with said two-parts junction member, which is called below also buckle. The Bowden-cable flexible transmission passes inside along a first section of shoulder-trap and is retained removably by a pawl thereof in a correspondent seat. This seat is formed in a second part of the junction member, this second part being connected to a second section of shoulder-strap and defined by a first part of the junction member of the first section of shoulder-strap, when the junction member is closed.

In such a way, when a person wearing the bag is tugged sharply in an attempt of bag-snatching, one section of shoulder-strap is separated from the other, after exerting a traction on the Bowden cable flexible transmission that controls the release mechanism.

The above mentioned ejection device, even if it fully reaches, with respect to the self-emptying effect of the bag, the goals of the Italian patent No. 1.307.293, has the drawback that the junction member as made does not allow the ejection device to be restored easily and quickly after an operation of the release mechanism.

Therefore, a object of the present invention is to overcome the drawback above mentioned by a self-emptying bag having a quick coupling buckle assembly, in particular for shoulder-strap, comprising a lining being hold removably with its upper hem near the edge of the opening of a bag, an expandable sack being arranged on a base of the bag below the lining, a small compressed gas bottle having a pierceable mouth, an housing being connected to the small compressed gas bottle and to the expandable sack, internally carrying a piercing bit, a release mechanism to push the piercing bit against the small compressed gas bottle, comprising a release member, and control means of said release mechanism including a flexible transmission, having in the one of its ends a connection to the release member and in the other one to a buckle assembly comprised of two parts that are respectively fixed to two sections of a shoulder-strap or similar holding portion of the bag so that a snatch, being transmitted to said portion of the bag through the flexible transmission, operates the release mechanism and causes the expandable sack to be inflated until the lining is completely overturned outside, characterized in that

- the flexible transmission of control means is connected in its other end to a coupling member movable inside the first part of buckle assembly;
- the coupling member, generally hexagonal in plan, is provided with a gripping jaws, which are elastically deformable from their normally wide apart position to their position facing a symmetrical plane being parallel to the hexagonal plan; said gripping jaws having end projections;
- the first part of buckle has external side arms, which are angularly tapered toward their ends and provided with undercuts in their internal side;
- the second part of buckle has central arms with their ends being transversally hook-shaped, said central arms being designed to be fit between said end projections of the gripping jaws of the coupling member and to be retained by the same end projections, and the curved side arms being designed to be fit among the external side arms of the first part of buckle and said gripping jaws of the coupling member and having ends thickened toward outside to engage said undercuts of the external side arms of the first part of buckle;

in such a way that at first the second part can be detached from the first part of buckle and then the second part of buckle can be detached from the coupling member after a traction has been exerted on the coupling member for disengaging the release element and causing the small bottle to be pierced.

Now this invention will be described with reference to its preferred embodiment, although it should be appreciated that modifications can be brought without departing from the scope of the invention, with connection to the figures of the enclosed drawing, wherein.

Figure 3:
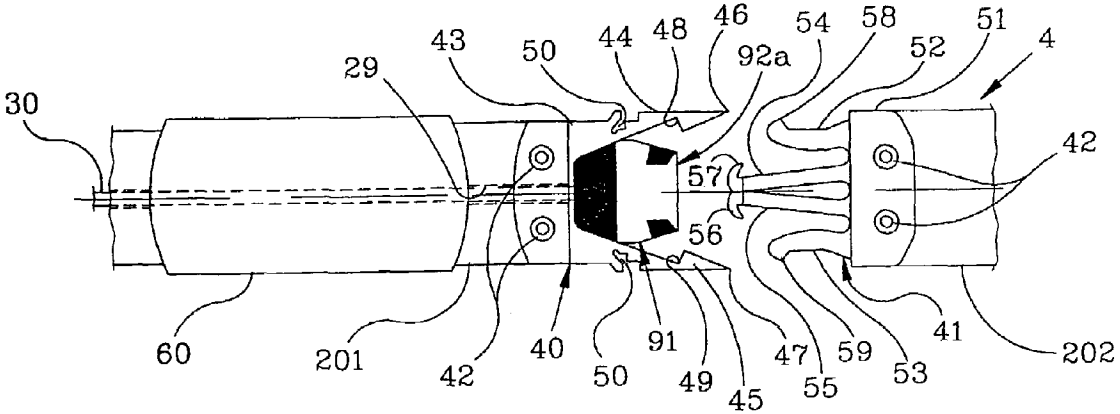
FIG. 3 is a partially sectioned view of a buckle assembly for shoulder-strap according to the present invention in a fully opened condition.
Figure 7:
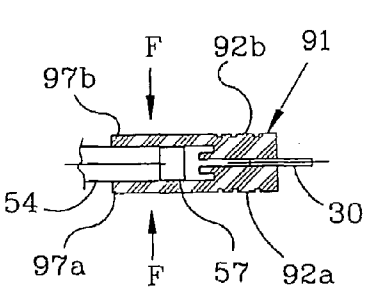
Figure 6:
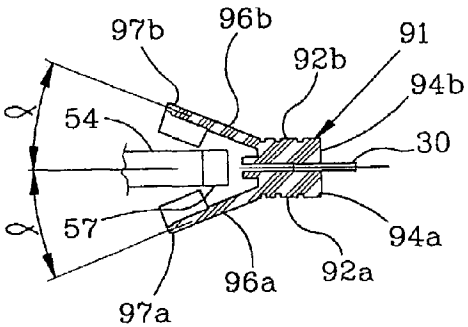
Figure 5:
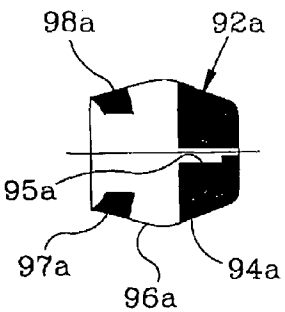
FIG. 5 is a cross-section view of the coupling member in FIG. 4.
Figure 4:
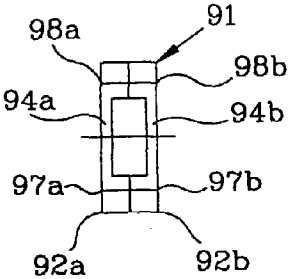
FIG. 4 is a front view of a coupling member of the buckle assembly in FIG. 3.
Figure 10:
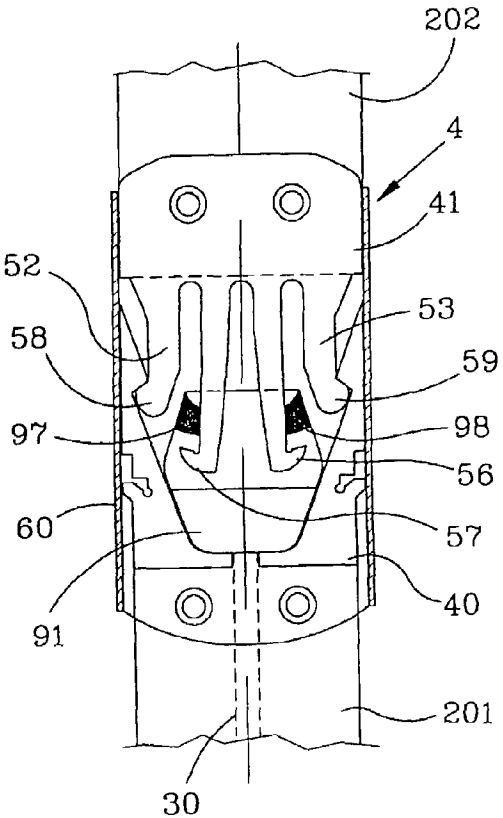
Figure 9:
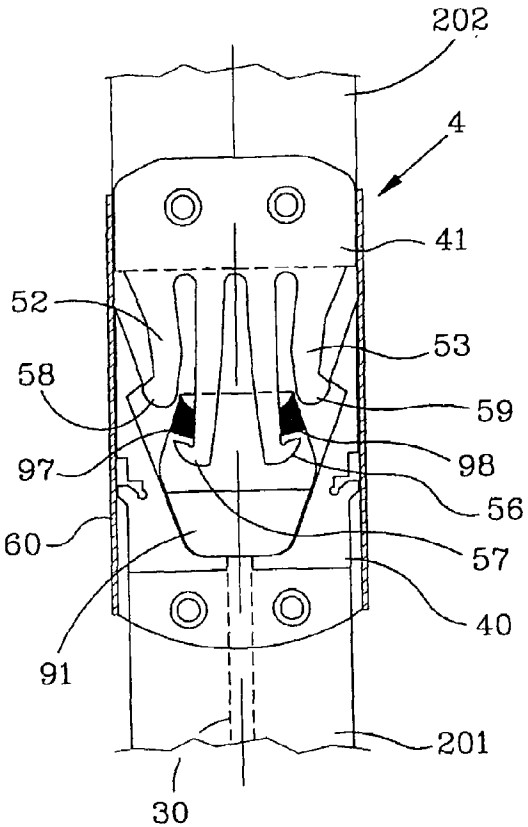
Figure 8:
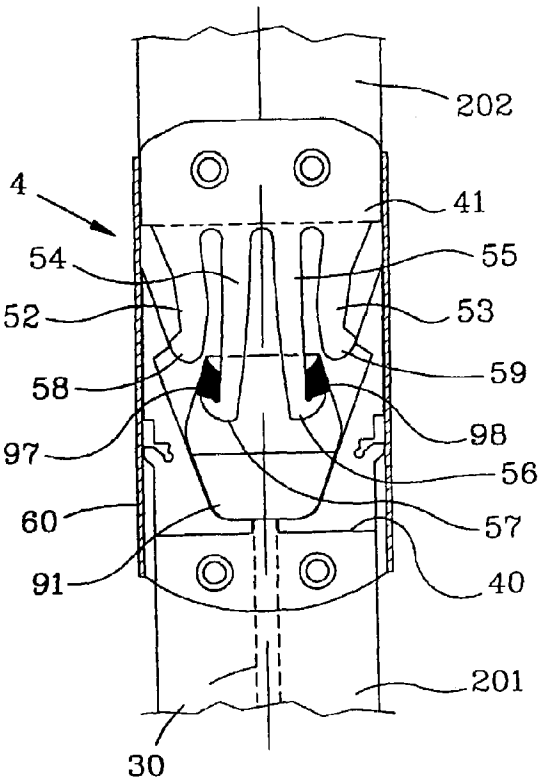

FIGS. 6 and 7 are longitudinal section view of the coupling member in FIGS. 4 and 5 engaging a right hand portion of the buckle assembly in FIG. 3; and FIGS. 8, 9, and 10 are partial sectioned views of the buckle assembly in FIG. 3 in three subsequent times before its complete closure.

Figure 1:
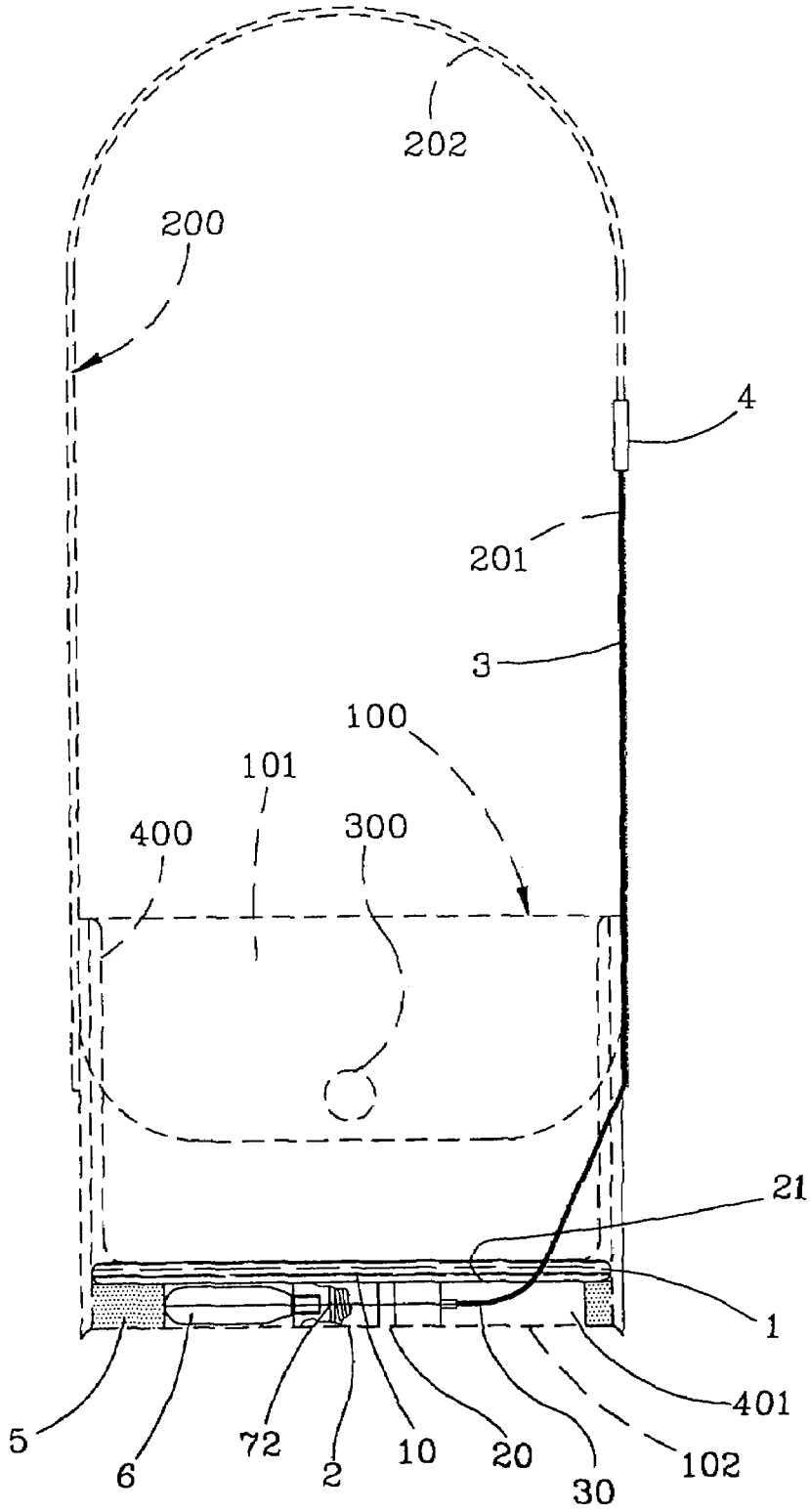
FIG. 1 is a diagrammatic, partially sectioned, front view of a self-emptying closed bag, as shown with dotted lines, having a shoulder-strap in which the buckle assembly according the present invention is applied.
Figure 2:
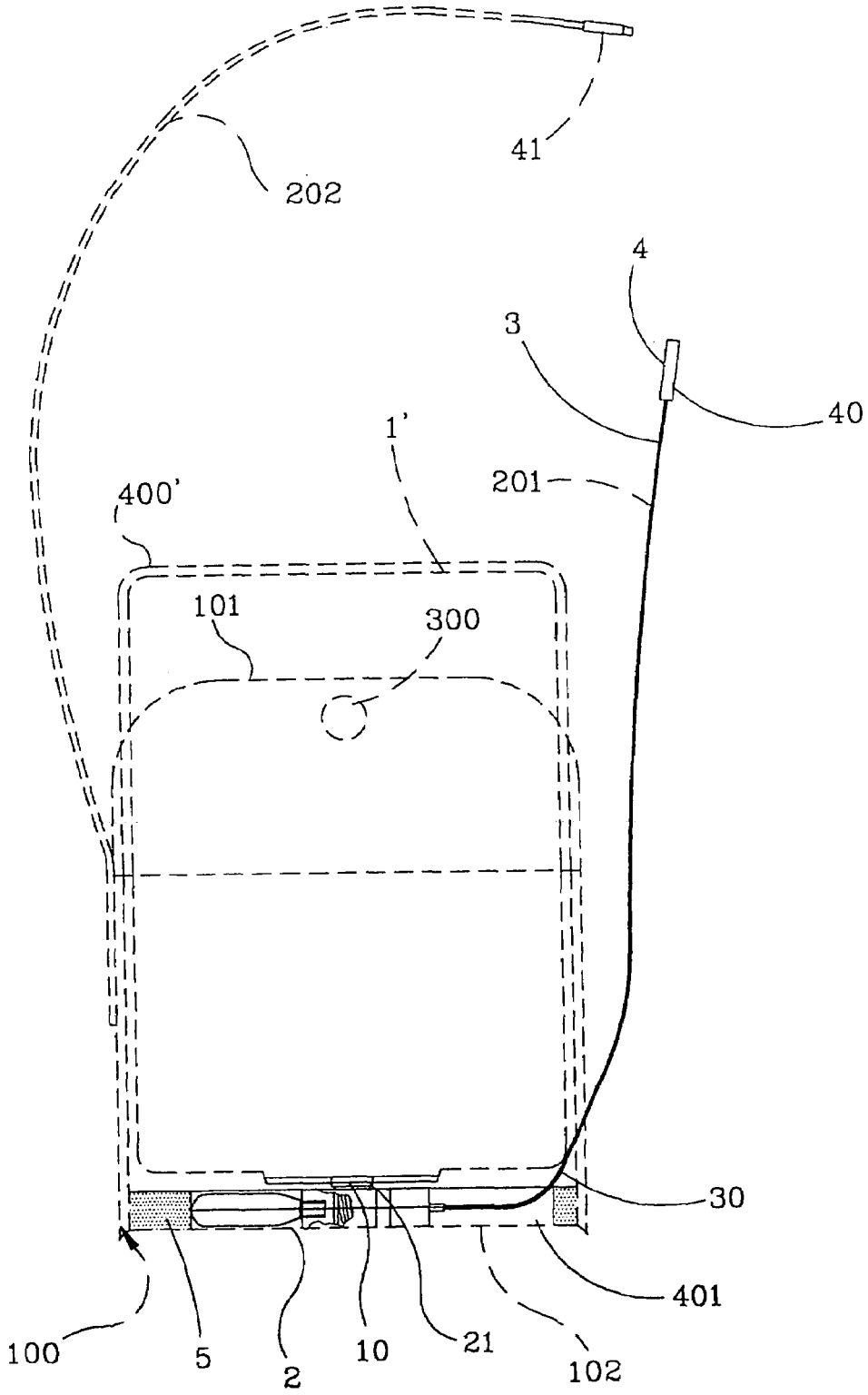
FIG. 2 is a diagrammatic, partially sectioned, front view of the bag in FIG. 1 in an emptied condition.

Referring to the drawing, a self-emptying bag 100, in which a buckle assembly according to the invention is employed, is shown as a whole in FIGS. 1 and 2. The self-emptying bag 100 is depicted by dotted lines in a closed condition and in an opened condition, respectively. The bag 100 is endowed with a shoulder-strap 200. The bag 100 is provided with a folding cover 101. With respect to closure means of the folding cover 101, that is diagrammatically shown in 300, it can be of any suitable kind, such as press-stud, Velcro (trademark) or the like, provided that it is yielding under the action of an ejection device, in order to allow the bag to be opened and its contents to fall down.

Conveniently the bag 100 is lined inside by a lining 400 shaped as a pocket that is preferably held, although this is not shown in the drawing, in its upper hem by the edge of the bag in a removable way, e.g. by means of a zip or so called Velcro. Thus, by opening the zip or moving away the edges of Velcro from each other, a hand of a person may enter easily a space 401 between the bottom of the lining 400 and the base 102 of the bag 100.

An ejection device is located in the space 401. The ejection device comprises an expandable sack 1, a compressed gas or air feeder 2, Bowden flexible-transmission control means 3 and a buckle assembly 4 joining two sections, 201, 202, of the shoulder-strap 200.

The airtight expandable sack 1, diagrammatically depicted in its collapsed state in FIG. 1, is arranged in a collected way, e.g. folded, under the lining 400. In this inflated state (FIG. 2) the expandable sack 1' takes on the form of a prismatic body, so to be able to keep the lining 400 overturned in 400' as shown in the same figures.

At the bottom the expandable sack 1 is hermetically connected through connection duct 10 to a base 21 projecting laterally from an elongated housing 20 of a compressed gas feeder 2. The small gas bottle has such a capacity that the expandable sack 1, after being inflated instantaneously, is able with its expansion to exert a sufficient force to expel objects contained inside the bag 100 between the lining 400 and the bag cover 101 upon the opening of the closure means and the overturning of the cover.

The gas bottle 6 is closed in its mouth by a septum that is easily pierceable by a piercing bit 72 (not shown in detail).

A flexible transmission 30 of control means 3 (also this device is neither described or shown in detail) passes through a shoulder-strap 201 and is connected to the buckle assembly 4 by means of a coupling member 91. The buckle assembly 4 is comprised of first and second parts 40, 41, that are shown in detail in FIGS. 3 to 7. The FIGS. 8 to 10 are views showing subsequent closure steps of the buckle 4.

The parts 40, 41 of the buckle assembly 4 are joined to the ends of a first and second sections 201, 202, respectively, of the shoulder-strap 200. As shown in FIGS. 1 and 2, the strap sections 201 and 202 are chosen so long that the buckle assembly 4 is placed in front of who wears the bag, if he or she is not left-handed. If the bag were carried on the left hand side, it would be suitable that the section 201 is longer than the section 202, otherwise control means might be inefficient, as it will be understood from the following of the description. Suitably, the sections 201 and 202 can be of the same length.

As shown in FIGS. 4 to 7, the coupling member 91 is comprised of two parts 92*a*, 92*b*, being generally hexagonal in plan. As shown in particular in FIG. 5, the part 92*a* of the coupling member 91 has a body portion 94*a*, with a through hole 95*a* being performed therein adapted to fasten the flexible transmission 30 to the coupling member 91. The body portion 94*a* extends with a gripping jaw 96*a*, which, flattened in its form, has at its ends two angled projections 97*a*, 98*a*, being of the same thickness as the body portion 94*a*. Analogously, the part 92*b* has a body portion 94*b* extending with a gripping jaw 96*b*, which has at its ends two angled projections 97*b*, 98*b*.

Normally, the gripping jaws 96*a*, 96*b* are inclined in an angle $\alpha$ to the body 94*a*, 94*b*, i.e. with respect to the symmetrical plane parallel to the hexagonal plan of the coupling member 91. This is shown in FIG. 6, in which the coupling member 91 and the second part 41 of the buckle assembly 4 are partially depicted. The gripping jaws 96*a*, 96*b* are able to be deformed elastically in closure to a position in which they are facing said symmetrical plane and the angle $\alpha$ is reduced to zero. This occurs under the action of a couple of counteracting forces F, as diagrammatically shown in FIG. 7, as a result of slidably positioning of a sleeve 60 on the parts 40, 41 of the buckle assembly 4.

Further, the gripping jaws 96*a*, 96*b* are elastically deformable along a transversal direction so that the projections 97*a*, 97*b*, that are generally spaced apart with respect to the projections 98*a*, 98*b* of respective arms, can approach each other.

The buckle part 40, as shown in FIG. 3, is so shaped to laterally define the coupling member 91, which for clarity sake is depicted in longitudinal section view. In other words, only part 92*a* thereof is shown.

The part 40 of buckle 4, that is fixed to the shoulder-strap section 201 by means of rivets 42, has a body 43 extending in arms 44, 45, that are externally parallel and tapered to respective tips 46, 47 with undercuts 48, 49. The arms 44, 45 are flexible, but their flexibility is increased by virtue of reductions in their cross-section thickness, which are indicated generally as 50.

The body 43 has a through hole 29 for the flexible transmission in such a way that the flexible transmission reaches the coupling member 91 contained inside the part 40 of buckle 4.

The part 41 of buckle 4, that analogously is fixed to the shoulder-strap section 202 by means of rivets 42, has a body 51 extending in both a pair of curved side arms 52, 53 and a pair of central arms 54, 55, that are contained between the curved side arms 52, 53 and are longer than the latter.

The central arms 54, 55 have end portions 56, 57, which are hook-shaped toward outside, and the curved side arms 52, 53, which are concave toward outside, end with a tip 58, 59 which is thickened toward outside.

A sleeve 60 is used to cover the buckle 4 in its closure position, being obliged to slide along the section 201 of the shoulder-strap 200.

In the operation of the buckle according to the invention, the hook-shaped ends 56, 57 of the mutually spaced apart arms 54, 55 are inserted between the normally wide apart, gripping jaws 96*a*, 96*b* of the coupling member 91. The parts 40, 41 of buckle 4 are approached each other until they are in the position shown in FIG. 10. In this position, the thickened tips 58, 59 of the curved side arms 52, 53 of the part 41 are in the undercuts 48, 49 of the arms 44, 45 of buckle part 40. Instead, the hook-shaped ends 56, 57 of buckle part 41 are beyond the angled projections 97*a*, 98*a* and 97*b*, 98*b*. The sleeve 60 is on the joined parts 40, 41 of buckle 4, preventing the gripping jaws 96*a*, 96*b* of the coupling member from being stretched apart on the central arms 54, 55 of the second part 41 of buckle with a consequent detachment.

If a force is exerted on one of the shoulder-strap sections 201, 202 from the position shown in FIG. 10, the second part 41 of buckle 4 tends to move away from the first part 40 of the same buckle, with a first disengagement of the thickened tips 58, 59 of the curved side arms 52, 53 from the undercuts 48, 49 of the arms 44, 45 of the first part 40 of buckle. This is shown in FIG. 9. The hook-shaped ends 56, 57 of the second part 41 of buckle are almost in contact with the angled projections 97*a*, 98*a* and 97*b*, 98*b*, preventing yet the transversal deformation.

If the force on the shoulder-strap is further increased, the position shown in FIG. 8 is reached, in which the curved side arms 52, 53 of the second part 41 of buckle engage no longer the arms 44, 45 of the same. A further force applied provokes a traction exerted by the hook-shaped ends on projections 97*a*, 98*a*, 97*b*, 98*b*, causing the mutual transversal removal for the projections on the respective arms, and the movement of the coupling member 91 with respect to the first part 40 of buckle and then the separation of the second part 41 of buckle from the coupling member 91, and finally the separation of the shoulder-strap 200 into its two sections 201, 202.

In the same time a traction force is exerted on the flexible transmission 30 that acts in a known way on the release mechanism of ejection control means.

In summary, the operation of ejection control means is the following. In the condition in which the two sections 201, 202 of shoulder-strap are joined by the buckle assembly 4, the second part 41 of buckle engages the first part 40 thanks to that the tips 58, 59, being thickened toward outside, of the curved side arms 52, 53 of the part 41 are in the undercuts 48, 49 in the internal side of the side arms 44, 45 of buckle part 40 (FIG. 10). As a result of a sufficient traction on the part 202 of the shoulder-strap 200, the tips 58, 59 engage no longer the undercuts 48, 49 (FIG. 9) and the second part 41 of buckle is separated from the first part 40. The arms 52, 53 do not impede further the mutual removal of the projections 97, 98 (FIG. 8). Then, the further traction on the shoulder-strap section 202 causes a consequent traction on the flexible transmission 30 until that, after the operation of the release mechanism, the hook-shaped ends 56, 57 toward outside of the central arms 55, 54 are separated from the projections 97, 98 bringing about the detachment of the second part 41 of buckle from the coupling member 91 and then the separation of the section 202 from the section 201 of shoulder-strap 200.

In order to rearrange the buckle 4 of the shoulder-strap 200 after the ejection, it is necessary first to release the coupling member 91 from the engagement with the sleeve 60, then the gripping jaws 96*a*, 96*b* are closed like pliers onto the hook-shaped projections 56, 57 of the arms 55, 54 of the second part 41 of buckle assembly 4, in order to retain the latter. The sleeve 60 is moved onto the buckle assembly 4, as shown in FIG. 8. Then, the second part 41 of buckle is further approached to the first part 40 of buckle until the tips 58, 59, thickened toward outside, of arms 52, 53 go to fit in respective recesses 48, 49 of external arms 44, 45 of the second part 40 of buckle. Thus the shoulder-strap 200 is completely restored.

The invention claimed is:

1. A self-emptying bag having a quick coupling buckle assembly, comprising a lining (400) being hold removably with its upper hem near the edge of the opening of a bag (100);

an expandable sack (1) being arranged on a base (102) of the bag (100) below the lining (400);

a small compressed gas bottle (6) having a pierceable mouth;

a housing (20) being connected to the small compressed gas bottle (6) and to the expandable sack (1), internally carrying a piercing bit (72), a release mechanism (8) to push the piercing bit (72) against the small compressed gas bottle (6), comprising a release member; and control means (3) of said release mechanism (8) including a flexible transmission (30), having in the one of its ends a connection to the release member (86) and in the other one to a buckle assembly (4) comprised of two parts (40, 41) that are respectively fixed to two sections (201, 202) of a shoulder-strap (200) or similar holding portion of the bag (100) so that a snatch, being transmitted to said portion of the bag through the flexible transmission (30), operates the release mechanism and causes the expandable sack to be inflated (from 1 to 1') until the lining is completely overturned outside (from 400 to 400'), characterized in that the flexible transmission (30) of control means (3) is connected in its other end to a coupling member (91) movable inside the first part (40) of the buckle assembly (4);

the coupling member (91), generally hexagonal in plan, is provided with a gripping jaws (96*a*, 96*b*), which are elastically deformable from their normally wide apart position to their position facing a symmetrical plane being parallel to the hexagonal plan; said gripping jaws (96*a*, 96*b*) having end projections (97*a*, 98*a*; 97*b*, 98*b*);

the first part (40) of buckle has external side arms (44, 45), which are angularly tapered toward their ends and provided with undercuts (48, 49) in their internal side;

the second part (41) of buckle has central arms (54, 55) with their ends being transversally hook-shaped, said central arms being designed to be fit between said end projections (97*a*, 98*a*; 97*b*, 98*b*) of the gripping jaws (96*a*, 96*b*) of the coupling member and to be retained by the same end projections, and curved side arms (52, 53) being designed to be fit among the external side arms (44, 45) of the first part (40) of buckle and said gripping jaws (96*a*, 96*b*) of the coupling member (91) and said curved side arms having ends (58, 59) thickened toward outside to engage said undercuts (48, 49) of the external side arms (44, 45) of the first part (40) of buckle;

in such a way that at first the second part (41) can be detached from the first part (40) of buckle and then the second part (41) of buckle can be detached from the coupling member (91) after a traction has been exerted on the coupling member (91) for disengaging the release element (86) and causing the small bottle (6) to be pierced.

* * * * *